US005572935A

United States Patent [19]

Schairbaum

[11] Patent Number: 5,572,935

[45] Date of Patent: Nov. 12, 1996

[54] ADJUSTABLE MONITOR SUSPENDING ASSEMBLY

[75] Inventor: Edward C. Schairbaum, Fort Worth, Tex.

[73] Assignee: Nova Solutions, Inc., Effingham, Ill.

[21] Appl. No.: 432,820

[22] Filed: May 2, 1995

Related U.S. Application Data

[63] Continuation of Ser. No. 885,570, May 19, 1992, Pat. No. 5,410,972.

[51] Int. Cl.[6] ..... A47B 35/00

[52] U.S. Cl. ..... 108/50; 312/223.3; 248/923

[58] Field of Search ..... 108/50, 23, 28; 312/223.3, 194, 196; 248/922, 923, 917, 324

[56] References Cited

U.S. PATENT DOCUMENTS

| | | | |
|---|---|---|---|
| Re. 34,266 | 6/1993 | Schairbaum . | |
| 2,870,985 | 1/1959 | Martin et al. . | |
| 4,562,482 | 12/1985 | Brown . | |
| 4,590,866 | 5/1986 | Schairbaum . | |
| 4,755,009 | 7/1988 | Price et al. . | |
| 4,964,606 | 10/1990 | Beam et al. | 248/923 X |
| 5,064,161 | 11/1991 | Anderson | 248/917 X |
| 5,071,204 | 12/1991 | Price et al. | 312/223.3 X |
| 5,087,010 | 2/1992 | Walters . | |
| 5,094,514 | 3/1992 | Grosch | 312/223.3 X |
| 5,101,736 | 4/1992 | Bommarito et al. . | |
| 5,118,172 | 6/1992 | Ugalde | 312/223.3 |
| 5,125,727 | 6/1992 | Lechman et al. . | |
| 5,139,223 | 8/1992 | Sedighzadeh | 248/324 |
| 5,179,367 | 1/1993 | Shimizu | 248/919 X |
| 5,199,773 | 4/1993 | Price, Jr. et al. . | |
| 5,408,939 | 4/1995 | Lechman | 312/223.3 X |
| 5,410,972 | 5/1995 | Schairbaum | 108/50 |

FOREIGN PATENT DOCUMENTS

| | | | |
|---|---|---|---|
| 1106895 | 8/1981 | Canada . | |
| 3427229 | 1/1986 | Germany . | |
| 3516855 | 11/1986 | Germany | 312/223.3 |
| 4100675 | 7/1992 | Germany | 312/223.2 |
| 8503626 | 8/1985 | WIPO | 312/223.3 |
| 3025117 | 12/1993 | WIPO | 312/223.3 |

*Primary Examiner*—Jose V. Chen
*Attorney, Agent, or Firm*—Olson & Hierl, Ltd.

[57] ABSTRACT

An adjustable monitor suspending assembly is provided for a monitor that is positioned under a transparent portion in the top surface member of a desk-like structure. The suspending assembly is adjustable and suspends a forward upper region and a rearward upper region of the monitor. The suspending assembly avoids the need for a shelf member for supporting lower portions of the monitor.

7 Claims, 4 Drawing Sheets

ADJUSTABLE MONITOR SUSPENDING ASSEMBLY

This is a continuation of application Ser. No. 07/885,570, filed May 19, 1992 now U.S. Pat. No. 5,410,972.

FIELD OF THE INVENTION

This invention relates to underdesk monitor suspending assemblies for desk structures and the like that have a transparent top portion through which a suspended monitor can be viewed.

BACKGROUND OF THE INVENTION

When a desk or similar structure is provided with a top member that incorporates a transparent surface portion, it becomes possible to position a cathode ray tube (CRT) or monitor under the desk top surface for viewability through the transparent surface portion. Such arrangements are shown, for example, in Schairbaum U.S. Pat. No. 4,590,866 and in Mcintosh Canadian Patent No. 1,106,895.

The monitor in such an arrangement is usually in operative and functional association with a computer central processing unit (CPU) which can be either in the desk structure or elsewhere as desired and a keyboard which can be supported either by the top member or some other component of the desk structure.

Because of the multiplicity of different desk structures and the like which can be equipped with a transparent top surface portion, there is a need in this new and developing art for a monitor suspending assembly that is adaptable for use in many different desk structures. The monitor suspending assembly should also be adjustable so as to regulate the tilt angle and the position of a suspended monitor relative to the overlying transparent surface portion of a desk structure so as to meet the needs of the particular use situation and the desires of the individual user. In addition, a monitor suspending assembly should be safe and effective during use.

The present invention provides such an improved monitor suspending assembly.

SUMMARY OF THE INVENTION

The present invention provides a new and improved adjustable assembly for suspending a monitor means or the like under a desk top surface that has a transparent portion.

The present invention also provides improved combinations of a desk or like structure with the adjustable monitor support assembly.

In the present invention, upper portions of a monitor are directly suspendable from portions of the desk top surface by an adjustable assembly.

This adjustable assembly preferably includes means for suspending each of the upper forward and the upper rearward portions of a monitor. In addition, this adjustable assembly preferably includes means for adjusting the monitor tilt angle and also the monitor transverse position relative to the overlying desk top surface member for desired viewability of the monitor screen angularly through the transparent portion in the desk top surface.

The adjustable assembly avoids the need for means to support bottom portions of the monitor yet a keyboard (if present) is movably independently associatable with the desk or like structure and also is independently movably associatable with the monitor. The CPU can be located wherever desired.

The inventive adjustable assembly uses a minimum of components and is structurally simple, easy to install and operate, adaptable for use with a wide range and variety of desk structures and work stations, reliable and substantially maintenance free.

Other and further aims, purposes, features, advantages and the like will be apparent to those skilled in the art from the present specification taken with the accompanying drawings.

BRIEF DESCRIPTION OF THE DRAWINGS

In the accompanying drawings, which comprise a portion of this disclosure.

DETAILED DESCRIPTION

Figure 1:
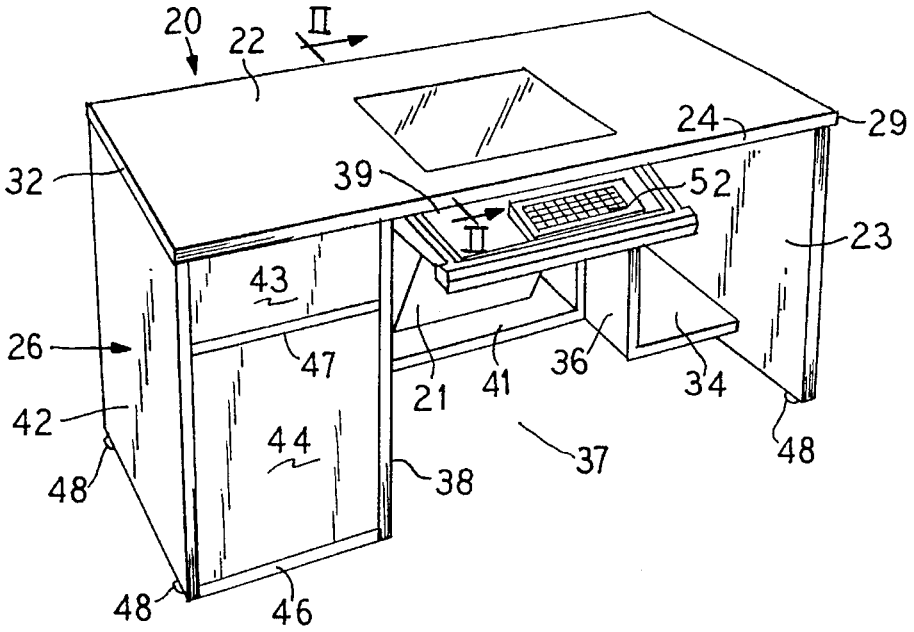
FIG. 1 is a perspective view of one embodiment of a monitor support assembly of the present invention mounted under one illustrative type of desk structure and in association with an illustrative monitor.
Figure 2:
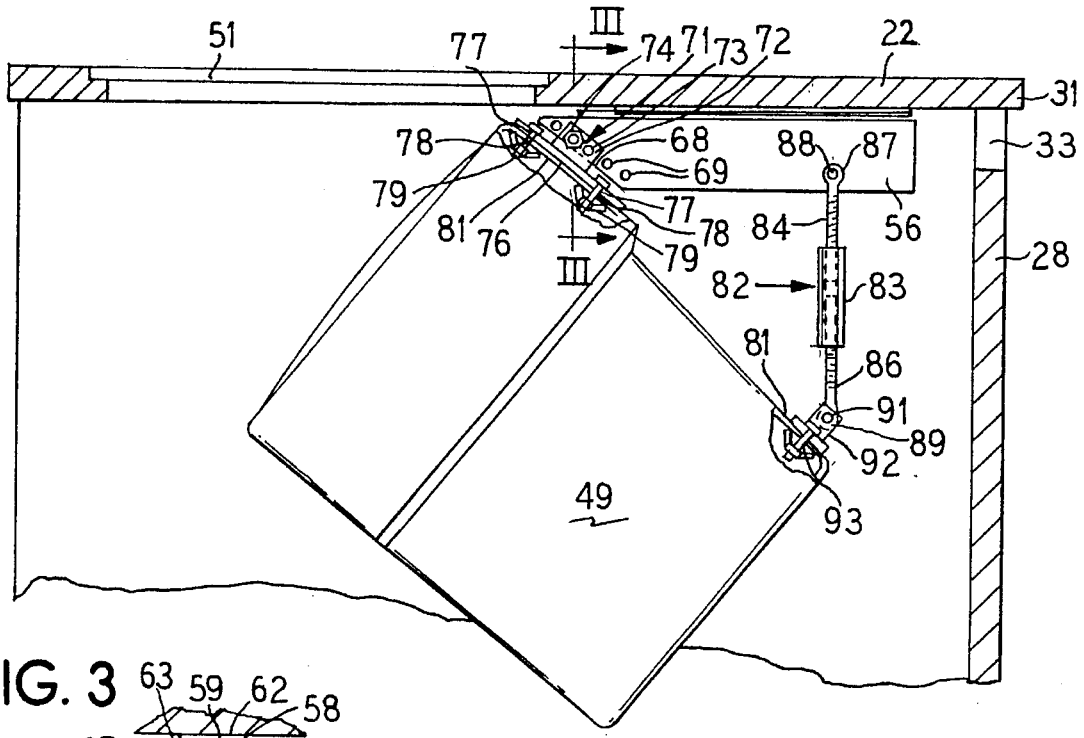
FIG. 2 is a vertical, transverse sectional view taken along the line II—II of FIG. 1 with some parts thereof being broken away and some parts thereof being shown in section.
Figure 3:
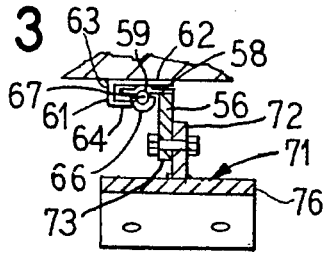
FIG. 3 is a fragmentary enlarged vertical lateral sectional view through a forward portion of the monitor support assembly of FIG. 1 taken along the line III—III of FIG. 2, some parts thereof being broken away and some parts thereof being shown in section.

Referring to FIGS. 1–3, there is seen an illustrative embodiment of a desk-like work station 20 that is functionally associated with one embodiment of a monitor suspending assembly 21 of this invention. The desk 20 has a generally rectangular flat top surface member 22. Desk 20 is suitable for positioning adjacent a wall or in a room interior or elsewhere as desired. However, any shape or size of desk structure can generally be used with assembly 21.

The top flat surface member 22 of desk 20 is supported by a peripheral side wall 23 along and under its right side edge 29 (relative to a user seated along a mid-region of the elongated front side edge 24 of member 22, the user not being shown in the Figures). Undersurface portions of flat top surface 22 adjacent the left side edge 32 thereof are supported by a pedestal structure 26. The side wall member 23 and the pedestal structure 26 adjoin a back wall member 28 (see FIG. 2, for example) that extends under and across the back side edge 31 of top flat surface member 22. A slot 33 is provided which extends between the top of back wall 28 and the undersurface portions of top surface member 22 for air circulation purposes.

Secured to, and inwardly extending from, side wall 23 in upwardly spaced, parallel relationship to the bottom edge of the side wall 23 is a shelf member 34 which is secured along its interior lateral right side edge to a vertical supporting panel 36. The top edge of panel 33 is secured to the underside of the flat top surface member 22 and the back edge of panel 36 is secured to the inside of back wall member 28.

A kneehole 37 is thus defined between the panel 36 and the inside wall 38 of the pedestal structure 26. Under the surface member 22 across the kneehole 37 is slidably mounted a transversely short keyboard holding platform or tray 39 that is transversely and horizontally slidable relative to the front edge 24 of top surface member 22 from a closed position (not shown) to a fully extended position such as shown in FIG. 1. While any convenient structure can be used for the platform 39 and its slidable mounting means, the structure shown in copending U.S. patent application Ser. No. 693,392 filed Apr. 30, 1991 is now preferred (the disclosure of which is incorporated herein by reference).

Desk 20 is provided with a recessed rigidifying and structure reinforcing lower shelf member 41 that extends between, and is secured at its opposite ends to, respectively, panel 36 and wall 38, and also at its rear end to the inside of back wall 28. In the pedestal structure 26, and located between and suspended by the inside wall 38 and the outside wall 42 thereof, a plurality of conventional storage drawers 43 and 44 or the like are conveniently provided. Between the lower edge portions of walls 38 and 42 and drawers 43 and 44 rigidifying horizontal strut members 46 and 47, respectively, are secured. Opposite bottom corners of desk 20 are supported by conventional, preferably adjustable, feet 48 (four) relative to a floor (not shown).

A central processing unit (CPU) (not shown) can be housed, if desired, under surface member 22 on the shelf 34.

An illustrative monitor 49 (see FIG. 2) is positioned at a location in an upper rear region of the kneehole 37 from where its screen is visible through a transparent portion, such as is provided by a rectangular or square insert piece or plate 51 that is comprised of glass, clear plastic, or the like, and that is inset centrally in, and is supported by, surface member 22. The monitor 49 is supported by the monitor suspending assembly 21. The monitor 49 and a keyboard 52 that is shown resting on the keyboard holding platform 39 are each functionally interconnected by electrical cables (not shown) or the like with a CPU. Thus, a complete computer processing work station can be provided within the desk structure 20, if desired. Alternatively, a CPU can be located remotely (not shown) relative to the desk 20, and the monitor 49 and the keyboard 52 can be connected therewith by electrical cable means (not shown) as those skilled in the art will readily appreciate.

Monitor support assembly embodiment 21 incorporates an elongated, flattened, vertically oriented hanger plate 56 that transversely extends from a mid-region of the rearward edge of the transparent plate 51 backwards towards backwall member 28. The plate 56 is conveniently formed of sheet metal or the like. The top edge of plate 56 is provided with an outturned integral flange 58 which preferably extends perpendicularly relative to plate 56. The lower surface of flange 58 is provided with an elongated detent 59 that extend in spaced, parallel relationship to plate 56.

A generally cross-sectionally U-configured elongated slide plate 61 is provided wherein one arm 62 thereof has a greater width outwards from the U-curvature 63 thereof than the other arm 64. The wider arm 62 is mounted conveniently by screws or the like (not shown) to the underside of the top surface member 22 so as to cause the slide plate 61 to extend from a location generally transversely adjacent to the rearward edge of the transparent plate 51 backwards to a terminus which is in spaced relationship to the back wall member 28. The narrower arm 64 is provided with a cross-sectionally C-configured channel 66 that extends along and adjacent its outer end and in this channel 66 are located a plurality of successive ball bearings 67 that are in aligned longitudinally spaced adjacent relationship one to another. Conventional means (not detailed) permit each ball bearing 67 to roll in a stationary position in channel 66 is provided. When the flange 58 is inserted into the mouth of the slide plate 61 so that the detent 59 extends over upper surface portions of the ball bearings 67 in channel 66, the flange 58 and the associated hanger plate 56 are slidable transversely along the slide plate 61, as desired. Set means (not shown) can be utilized if desired to hold the hanger plate 56 at a prechosen location along slide plate 61.

The transversely forward end of the hanger plate 56 is beveled (or angled) from the upper forward end thereof back downwardly to the bottom edges thereof. Along and adjacent the diagonal edge 68 defined by the bevel a plurality of successive holes 69 are provided in spaced relationship to one another. A bracket 71 is provided which has a centrally upstanding plate portion 72 that has apertures 73 formed therein that are alignable with one or more of the holes 69. Nut and bolt assemblies 74 that are extended through the aligned holes 69 and apertures 73 that function to mount the bracket 71 to the forward end portion of the hanger plate 56. The particular combination of holes 69 and apertures 73 that is selected serves to position the bracket 71 spacing relative to the underside of the top member 22. Preferably, only a single nut and bolt assembly 74 joins the bracket 71 to the hanger plate 56 so that the bracket 71 is pivotally associated with the hanger plate 56.

The base plate portion 76 of the bracket 71 extends perpendicularly from plate 72 and is conveniently elongated at its opposite ends relative to the upstanding plate portion 72, thereby adapting the bracket 71 for easy mounting through apertures 77 formed in base plate portion 76 either to a monitor mounting bracket (not shown) that is either secured to the top frontal portion of the housing 81 of the monitor 49 or is directly secured to the housing 81 (as shown in FIG. 2). Monitor housing 81 is provided with holes 78 that are alignable with the apertures 77 in base plate portions 76 so that nut and bolt assemblies 79 can mount the housing 81 to the bracket 71, thereby supporting the forward end of the monitor 49 from the hanger plate 56.

A turnbuckle assembly 82 is employed to suspend the top rearward portion of the housing 81 of the monitor 49. The turnbuckle assembly 82 shown incorporates a metal sleeve 83 with opposite internal threads at each end along a common axis (not shown) which is threadably connected to one end of each of a pair of matingly threaded rods 84 and 86. Rod 84 has an opposite end which terminates in an eyelet 87 which is aligned with a hole 88 in a rearward portion of the hanger plate 56. A nut and bolt assembly or the like (not shown) interconnects the eyelet 87 with the hanger plate 56 pivotally. Rod 86 has an opposite end which likewise terminates in an eyelet 89 (shown in phantom) which is aligned with a hole 91 in the upstanding leg of an L-configured bracket 92 and which is connected thereto with a nut and bolt assembly rivet or the like (not shown). The lateral leg of the bracket 92 is connected to the rear of the top of the housing 81 by nut and bolt assemblies 93 or the like that extend through aligned holes in the bracket 92 and the housing 81.

Thus, the tilt angle of monitor 49 is adjustable by the turnbuckle assembly 82, the transverse position of monitor 49 relative to plate 51 is adjustable by slidably positioning the hanger plate 56, and the vertical height or spacing of monitor 49 relative to top member 22 is adjustable by selection of holes 69.

Figure 4:
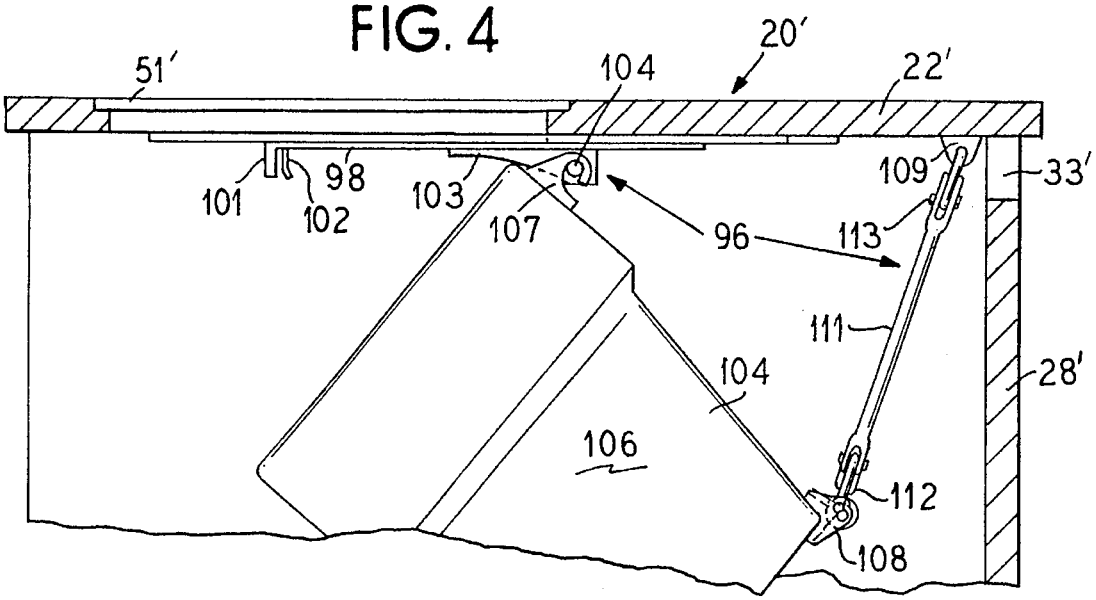
FIG. 4 is a view similar to FIG. 2 but showing the illustrative desk structure and an illustrative monitor in association with an alternative embodiment of a monitor support assembly of the present invention.
Figure 5:
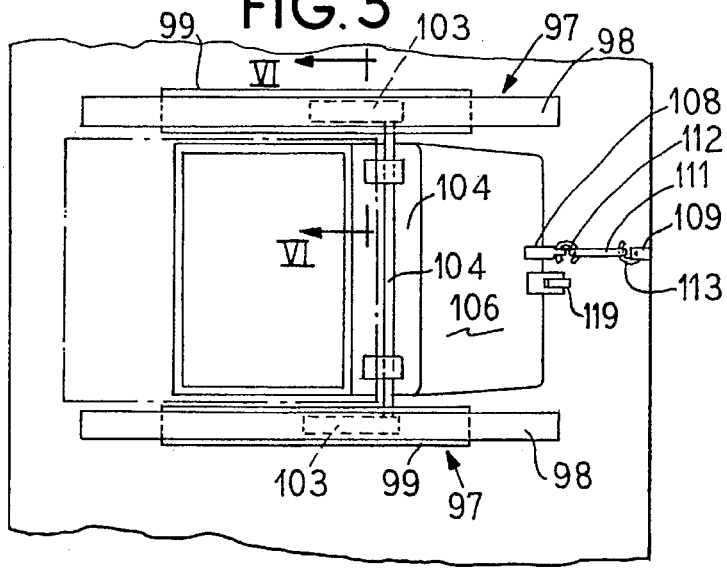
FIG. 5 is a top plan view of the embodiment shown in FIG. 4; but with the top surface member of the desk structure removed.
Figure 6:
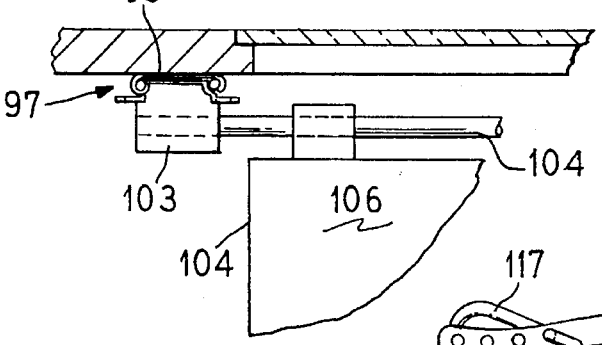
FIG. 6 is a fragmentary enlarged vertical lateral sectional view taken along the line VI—VI of FIG. 5.

Referring to FIGS. 4–7, there is seen another embodiment of a monitor suspending assembly 96 which is shown in combination with an illustrative desk 20'. Desk 20' is here illustratively similar to desk 20, and components thereof which are shown in FIGS. 4–6 are similarly numbered but include prime marks for identification.

Monitor suspending assembly 96 incorporates a pair of laterally spaced, parallel, transversely extending slide assemblies 97. Each assembly 97 includes an elongated flattened slide 98 which rides slidably and longitudinally in an elongated track 99. The track 99 has opposing sides that are configured to hook around adjacent respective opposing sides of the slide 98. The elongated flat base of each track 99 is mounted by screws or the like (not shown) against the underside of the top surface member 22' of desk 20. Each slide assembly 97 extends in the embodiment shown along a portion of a different side of transparent plate 51' and back towards the back wall member 28'. Each slide 98 terminates at its forward end in an upstanding rigid flange 101 (see FIG. 4) that is suitable for manual engagement by fingers of a user for purposes of accomplishing forward or backward sliding movements of rail 98 in its associated track 99.

Transversely adjacent to flange 101 is a base-pivotable trigger-like lever 102 that is mounted on a shaft extending between a pair of ears (not detailed) that are joined to slide 98. The base of lever 102 extends through slide 98 and joins a conventional brake assembly (not shown) that is spring biased in a braking configuration against opposite lateral side surfaces of track 99. The brake assembly is thus located between slide 98 and track 99 and has a flattened configuration. Because the brake assembly also offers reduced contact areas to track 99 compared to the undersurface of slide 98, the brake assembly also reduces frictional association between slide 98 and track 99 during slide 98 sliding movements. Thus, when lever 109 is manually pivoted by being pulled and tilted toward flange 101, the brake is released and the slide 98 and its connected brake assembly is slidable relative to the associated track 99.

A mid-region along the exposed outer surface of each slide 98 in each of the two slide assemblies 97 is connected to a post 103 by means of nut and bolt assemblies or the like (not shown). Suspended laterally (relative to desk 20') and extending longitudinally between the pair of posts 103 is a preferably cylindrical support bar 104. The bar 104 is moved transversely in adjacent spaced relationship to the underside of top member 22' and portions of plate 51' when each of the rails 98 is simultaneously slidably moved with each rail 98 being in an unbraked configuration (as above explained).

Adjacent each of the front outside opposite corners of the top of the case 104 of monitor 106, a hook 107 is mounted by screws, an adhesive or the like (not shown). Each hook 107 is oriented and adapted for extension over and engagement with an adjacent portion of bar 104 when the front upper region of monitor 106 is brought into proximity with the bar 104. Thus, the front of monitor 106 is suspended in an inclined manner for viewability through plate 51' by a user of desk 20'.

At a mid-region of the rear of the top of the case 104 of monitor 106 is mounted an eye 108 by means of screws or the like (not shown). Adjacent the back wall 28' and vent slot 33' another eye 109 is mounted at its base by means of screws, an adhesive or the like (not shown) against the underside of the top member 22'. A slightly elastomeric, relatively thick, flexible strap 111 (or an elastic cord) with an eye integrally formed therein at each end thereof is extended between eye 109 and eye 108 and is connected therewith by means of S-configured hooks 112 and 113. The rear of monitor 106 is thus suspended by strap 111. The length of the strap 111 can be varied by using a series of flexible straps to achieve various tilt angles for the monitor 106.

Figure 7:
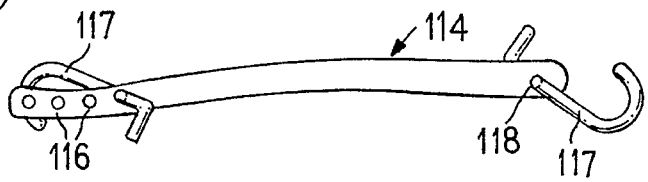
FIG. 7 is a plan view of an alternative embodiment of a monitor rear end suspending assembly for use in the monitor support assembly embodiment of FIGS. 4–6.

In place of a series of flexible straps 111, each of varying length, one can employ alternatively a bar (or strap) 114 such as shown in FIG. 7 where one end thereof is provided with a plurality of longitudinally spaced eyelets 116. By selecting an individual one of the eyelets 116 for association with a hook 117, the effective length of the bar 114 is changed. The opposite end of bar 114 can be provided with a single eyelet 118 (as shown), or alternatively, with a longitudinally spaced plurality of eyelets (not shown), each of which is engagable with hook 118.

Thus, monitor 106 can be adjustably tilted and adjustably transversely moved relative to desk 20' using the monitor suspending assembly 96.

Optionally, the top rear region of the case 104 of monitor 106 is provided with a caster or roller 119 which is adapted to roll along the inside of the back wall 28' and thereby to maintain a spacing between case 104 and back wall 28' for cooling purposes should the monitor 106 be slidably moved with assembly 96 into a position where case 104 is proximate to back wall 28'.

Figure 8:
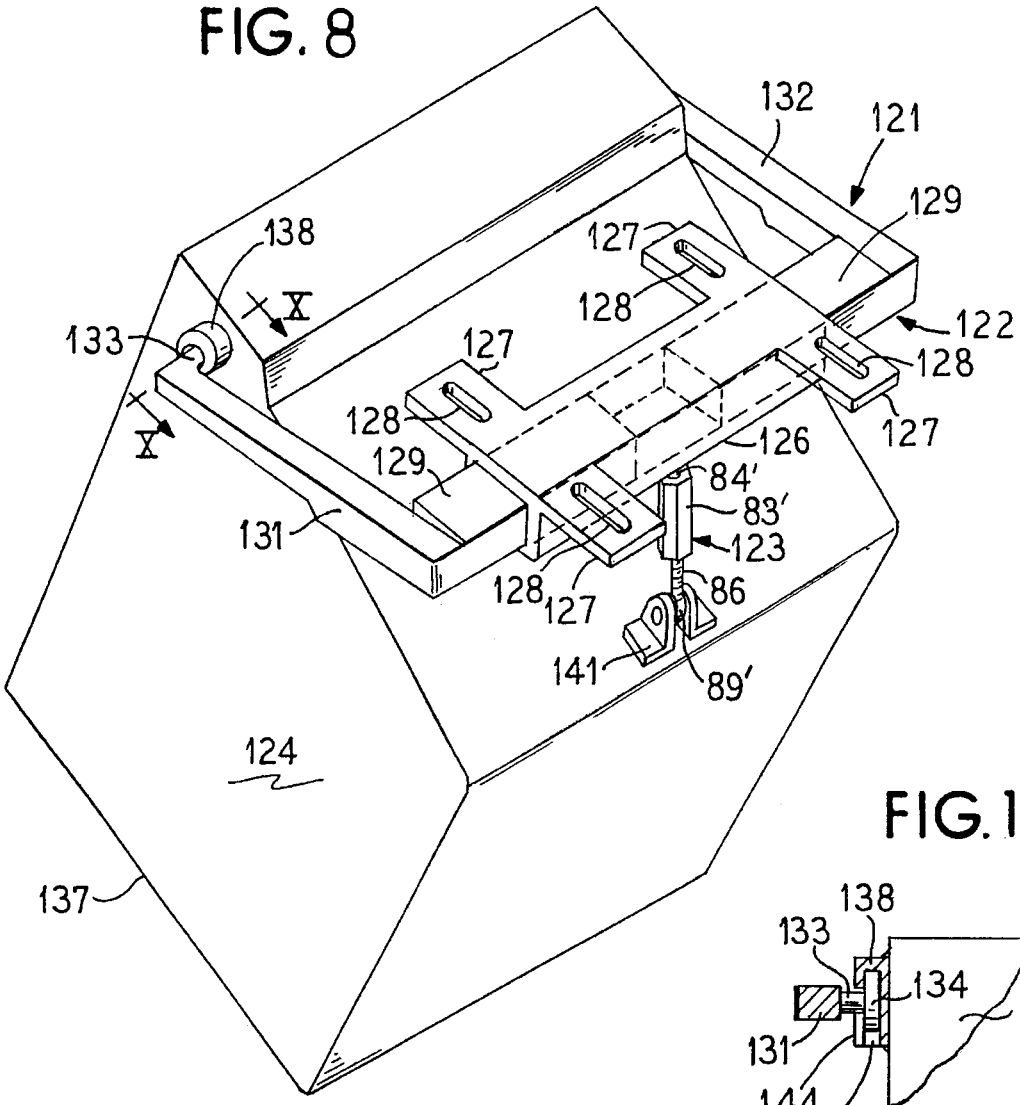
FIG. 8 is a perspective view of another alternative embodiment of monitor support assembly of the present invention in association with an illustrative monitor.
Figure 10:
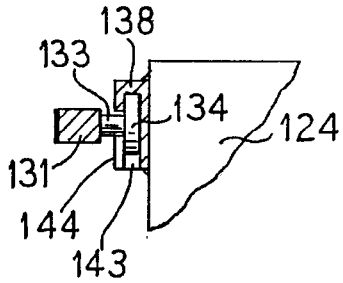
FIG. 10 is an enlarged fragmentary vertical lateral sectional view taken along the line X—X of FIG. 8.
Figure 9:
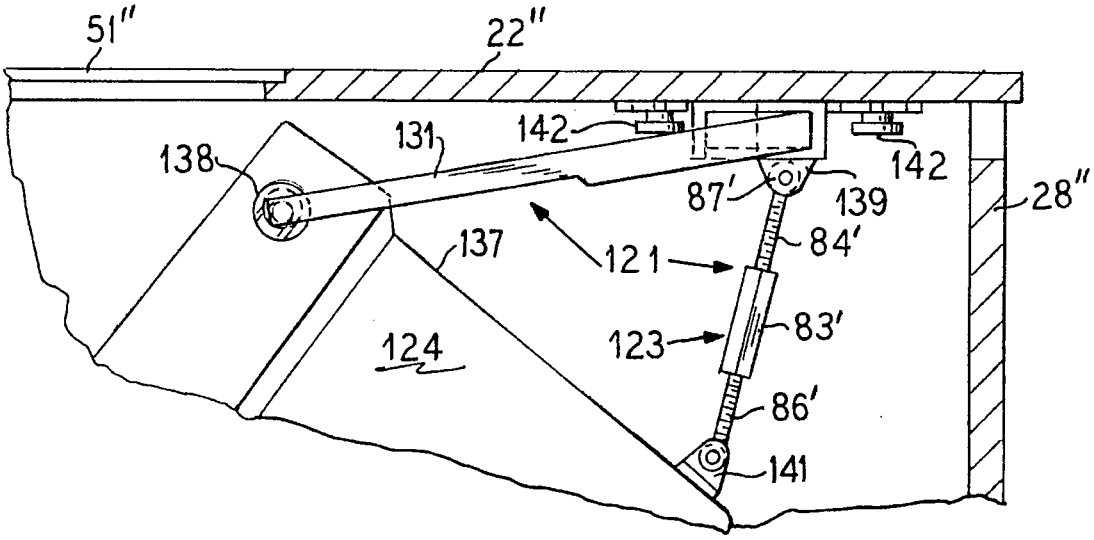
FIG. 9 is a view similar to FIG. 2, but showing the monitor support assembly of FIG. 8 in association with the illustrative desk structure of FIG. 1.

Referring to FIGS. 8–10, there is seen another embodiment of a monitor suspending assembly 121 which is shown in combination with an illustrative desk 20". Desk 20" is here illustratively similar to desk 20, and components thereof which are shown in FIGS. 8–10 are similarly numbered, but include double prime marks.

Monitor suspending assembly 121 utilizes a hanger frame 122 and a turnbuckle assembly 123 for suspending a monitor 124 under the top surface member 22" of desk 20".

The hanger frame 122 incorporates an elongated hollow channel member 126 which has a cross-sectionally rectangular configuration. Adjacent each opposite end thereof and outwardly extending from opposing narrow sides thereof in adjoining relationship to one broad side are pairs of outwardly extending brackets 127. The channel member 126 and two bracket pairs 127 are conveniently and preferably comprised of steel, and the butt end of each individual bracket 127 can be welded to the adjoining channel member 126.

Alternatively, each bracket 127 can be a single metal plate (not shown) which is welded or the like transversely across the opposite end of the channel member 126. Each individual bracket 127 is provided with an elongated slot 128 with the slots 128 at each end of channel member 126 having either a common longitudinal slot axis or having parallel slot axes. Thus, channel member 126 is adapted for mounting against the underside of top member 22" by thumb screws 142 or the like that extend threadably into top member 22" through the slots 128 with the thumb screw spacing be such that maximum slidable transverse adjustability is achieved for the laterally extending (relative to desk 20") channel member 126. Channel member 126 is thus located between the back edge of transparent plate 51" and the back wall 28".

A rectangularly configured pair of bar members 129 is provided, each of which has an exterior configuration which is slidably engagable with one end of the channel member 126. The outside end of each bar member 129 is fixed to one of a pair of supporting arms 131 and 132. Various configurations can be employed for the arms 131 and 132. In the assembly embodiment 21 shown, each arm 131 and 132 is a mirror image of the other, and each arm 131 and 132 includes a thickened shoulder region in the vicinity of the engagement with a bar member 129. Each arm 131 and 132 includes at its opposite or terminal outer end a stub shaft member 133 that extends normally outwardly therefrom. The stub shafts 133 are thus inturned and in opposed coaxial relationship relative to one another when each bar member 129 is slidably engaged with a different end of the channel member 126. A set screw or like means (not shown) that is extended through an exposed wall of channel member 26 can be used to fix the extent of slidable engagement between channel member 126 and each bar member 129. The bar members 129, arms 131 and 132, and the stub shafts 133 can each be comprised of a metal such as steel and these components can be separately formed and welded together at locations of engagement therebetween. Alternatively, these components can be of molded, one piece construction. The angle of declination of the arms 131 and 132 relative to channel member 126 and bar members 129 is fixed but this angle determines the height at which the front of the monitor 136 is suspended below the undersurface of the top member 22".

In the embodiment shown, each stub shaft 133 terminates in fixed association with an enlarged (relative to the shaft 133 diameter) disk-shaped head 134. The head 134 can be separately formed and fastened to the associated stub shaft 133 by screws, molding, adhesive or the like, or the head 134 can be integrally formed with the stub shaft 133.

The housing 137 of monitor 124 is joined at each side thereof adjacent to the case top and also adjacent to the front of monitor 124 to a side of one of a pair of U-configured configured supports 138. The mouth 143 of each support 138 is downturned (see, for example, FIG. 10), the internal width between the arms of each support 138 is slightly larger than the diameter of each head 134, and the outside of each support 138 has a channel 144 formed therein whose width is slightly larger than the diameter of each stub shaft 133. Thus, each head 134 is slidably engagable with a different support 138 in a hook-like manner, and, when both heads are so engaged, the monitor 124 front portion is suspended by the hanger frame 122.

A downwardly depending eyelet 139 is fixed (conveniently by welding or the like) to a mid-region of the channel member 126, and a double flanged eyelet structure 141 is fixed to the upper rear top central region of the housing 137 of monitor 124. The eyelet 141 and the supports 138 can be mounted with adhesive and thereby fixed to the housing 137. Alternatively, screw means, or the like (not shown) can be used.

The turnbuckle assembly 123 can have a structure similar to that of turnbuckle assembly 82, and corresponding parts are similarly numbered but with the addition of prime marks for identification purposes. Opposite end eyelets of turnbuckle assembly 123 are connected to the respective eyelets 139 and 141 when aligned therewith by nut and bolt assemblies, rivets, or the like (not shown). Thus, the rear end of the monitor 136 is suspended by the turnbuckle assembly 123.

The monitor suspending assembly 121 is adapted for adjustment of the tilt angle of a monitor 124 through length adjustments of the turnbuckle assembly 123, and is also adapted for adjustment of the transverse position of the monitor 124 relative to plate 52" through adjustment of the thumb screws 142 and the slidable transverse positioning of hanger frame 122 relative to screws 142.

Figure 11:
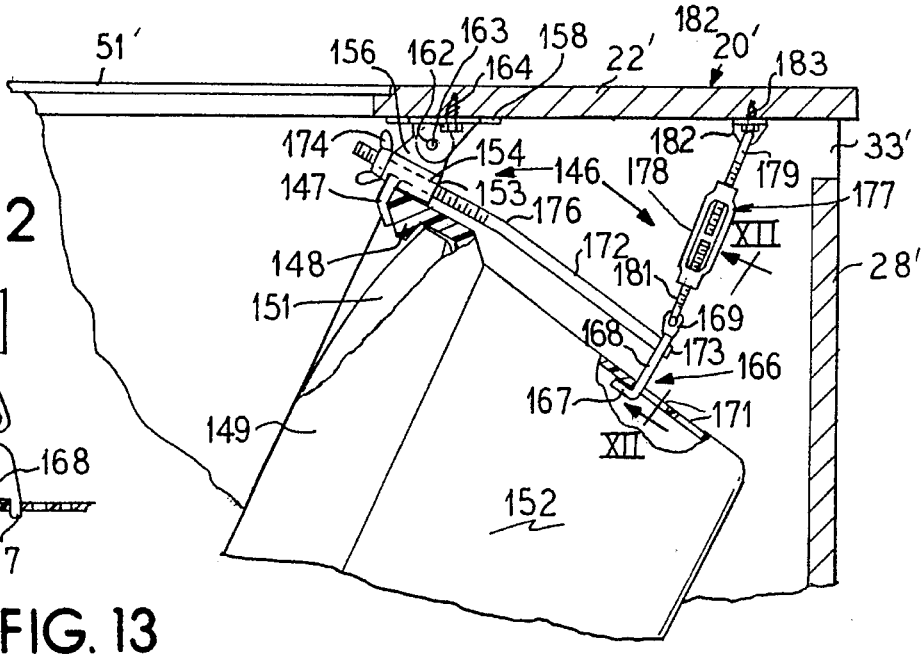
FIG. 11 is a vertical transverse sectional view similar to FIG. 2 with some parts thereof being broken away and some parts thereof being shown in section showing another alternative embodiment of a monitor support assembly of this invention.
Figure 12:
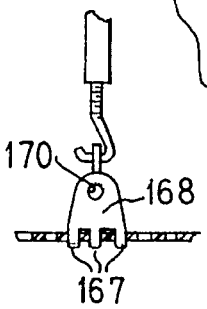
FIG. 12 is a fragmentary diagonal lateral sectional detail view taken along the line XII—XII of FIG. 11.
Figure 13:
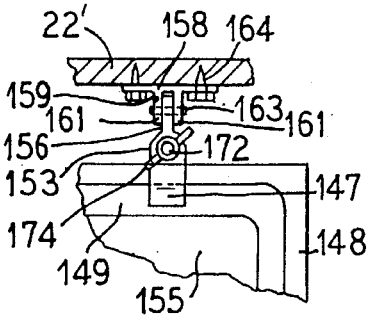
FIG. 13 is a fragmentary diagonal lateral sectional detail view taken along the line XIII—XIII of FIG. 11.

Referring to FIGS. 11–13, there is seen another embodiment of a monitor suspending assembly 146 which is shown in combination with an illustrative desk 20'. Desk 20' is here illustratively similar to desk 20, and components thereof which are shown in FIGS. 8–10 are similarly numbered, but include prime marks for identification.

To suspend a monitor 152, the monitor suspending assembly 146 incorporates a broad hook 147 whose shank is configured to fit against and grasp a top section of the frontally protruding portion of the frame region 148 of the monitor housing 149 that extends about the perimeter of the front face of the cathode ray tube 151 which is held within the monitor housing 149. The base of hook 147 is unitarily joined with a sleeve 153 that has an axial channel 154 extending therethrough with the channel 154 axis (not shown) being roughly in spaced, parallel relationship to the longitudinal axis (not shown) of the cathode ray tube 151. Radially extending from sleeve 153 in opposed relationship to hook 147 is a unitarily joined ear 156 through which a hole 157 extends normally relative to the channel 154 axis. The hook 147, sleeve 153, and ear 156 can be formed of a single body of molded plastic or the like. As those skilled in the art will appreciate, other hook structures can be used for grasping the top frame region of a monitor housing that extends about the front face of a cathode ray tube and for suspending the front forward top portion of a monitor.

A bracket 158 is provided with a base 159 and a pair of unitarily formed, closely spaced, parallel, upstanding plates 161. Opposite side regions of base 159 are provided with holes through which mounting screws 164 or the like are extended for mounting bracket 158 to the undersurface of the top member 22' of the desk 20' in transversely spaced rearward relationship to transparent plate 51'. The plates 161 are thus positioned and oriented so that ear 156 is slidably extendable therebetween with a hole being aligned with respective coaxial holes in each plate 161. A fulcrum pin 163 is extended through the aligned holes 162 and 157 so that hook 147 is pivotable about the axis (not shown) of pin 163 along with the monitor 152 that is connected therewith. As those skilled in the art will appreciate, and as indicated by other embodiments of the present invention taught herein, other arrangements can be used to suspend a hook arrangement, such as hook 147 and is associated components, from a desk top undersurface or the like.

Another hook 166 is provided which is equipped with at least one terminal finger, and preferably at least three fingers 167, as shown, for example, in FIG. 12. The fingers 167 extend preferably generally normally to the unitarily associated shank portion 168 of hook 166, and the fingers 167 are generally provided with a configuration and size which enables them as a group to be fitted in an angular hooking movement through ventilation orifices 171, such as are typically provided in the rear upper portion of the housing 149 of a monitor, as shown, for example, in monitor 152. Since such a housing 149 is typically and usually formed of molded plastic, the use of a plurality of fingers 167 which are in proximate but spaced relationship to one another distributes the load (and weight) of a monitor carried by hook 166, such as the monitor 152, over a region of monitor housing 149 which is believed to be desirable and is presently preferred. Also, the indicated angular relationship between shank portion 168 and fingers 167 is believed to aid in engaging and securing the hook 166 to a monitor, such as monitor 152, and also to adapt the hook 166 for use with a wide variety of different monitor housings and their different vent apertures.

The terminal end of the shank portion 168 of hook 166 is provided with an eye 169. In addition, the region of shank portion 168 adjacent the eye 169 is provided with an aperture (not detailed) whose axis (not shown) extends normally with respect to the axis (not shown) of eye 169, but is roughly parallel to the axis of the monitor 152 when the hook 166 is engaged as indicated with the monitor 152. The hook 166 can be formed of a single body of molded plastic or the like.

To retain hook 147 and hook 166 in association with the top portions of the monitor 152, a rod 172 is employed. In the embodiment 146, the rod 172 is provided with a rear retaining head 173 so that when rod 172 is slidably extended through the aperture in shank portion 168 that is adjacent eye 169, head 173 retains rod 172 engaged with hook 166. The forward end region of rod 172 is threaded and is adapted to slidably extend through the channel 154 in sleeve 153, and then a wing nut 174 or the like is threadably associated therewith. Tightening of nut 174 on rod 172 produces clamping tension between hooks 147 and 166 relative to housing 149, thereby clamping such hooks 147 and 166 to housing 149. A bend 176 in rod 172 is preferably provided to compensate for the declination that characteristically occurs in monitor housings as one proceeds from the front face to the rear end thereof.

To suspend the hook 166 from the underside top surface of top 22', a turnbuckle assembly 177 is employed. Turnbuckle assembly 177 employs a buckle 178 with opposite internal threads placed at each end region along a common axis (not shown), and buckle 178 is threadably connected to one end of each of a pair of matingly threaded rods 179 and 181. Rod 181 has an opposite end which terminates in another hook (not detailed) that is engagable with eye 169. Rod 179 has an opposite end which terminates in a hook (not detailed) that is engagable with an aperture in an outstanding plate of a conventional bracket 182 that is mounted by screws 183 or the like to the undersurface of top member 20' in adjacent relationship to rear wall 28'. Thus, the tilt angle of the monitor 152 is adjustable by the turnbuckle assembly 177.

Figure 14:
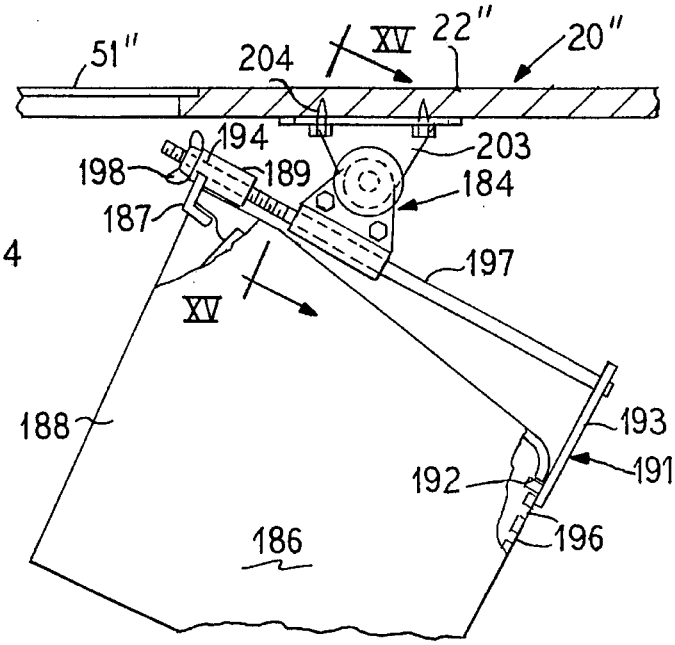
FIG. 14 is a vertical transverse sectional view similar to FIG. 2 with some parts thereof being broken away and some parts thereof being shown in section showing another alternative embodiment of a monitor support assembly of this invention.
Figure 15:
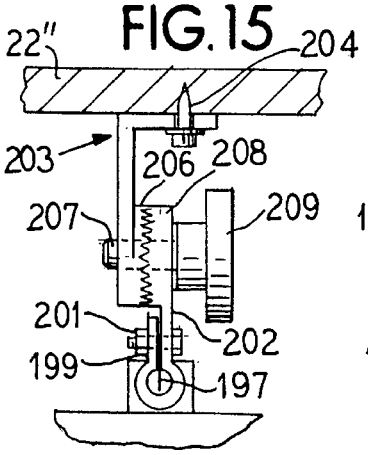
FIG. 15 is a fragmentary diagonal lateral sectional detail view taken along the line XV—XV of FIG. 14.

Referring to FIGS. 14 and 15, there is seen another embodiment of a monitor suspending assembly 184 which is shown in combination with an illustrative desk 20". Desk 20" is here illustratively similar to desk 20 and components thereof which as shown in FIGS. 14 and 15 are similarly numbered but with included double prime marks for identification.

To suspend an illustrative monitor 186, the monitor suspending assembly 146 incorporates a broad hook 187 which is similar to hook 147 and which engages a top section of the frontally protruding frame of monitor housing 188 similarly to monitor housing 149. Also, the base of hook 187 is similarly unitarily joined to a sleeve 189 that is similar to sleeve 153 and that has a similar axial channel 194 formed therein.

Another hook 191 is also provided which is equipped with at least one terminal finger 192 similarly to fingers 167 of hook 166, and such finger(s) 192 preferably (as shown) extend normally to the shank 193 of hook 191. Here, finger(s) 192 are shaped and configured to engage vents 196 which, in the present illustrative monitor 186, are located in an upper rear end region thereof. Hook 191 is further provided at the opposite end of its shank 193 thereof with an eye (not detailed) which is oriented towards sleeve 189. The length of shank 193 is preferably chosen to elevate and bring this eye generally into alignment with the channel 194 in sleeve 189.

A rear headed, forwardly threaded rod 197 is extended through and retained at the eye in hook 191 and is passed through channel 194 and threadably engaged with wing nut 198. Thus, the hooks 187 and 191 are clamped to the monitor 186 enabling it to be top suspended. The rod 197 is provided with a clamp 199 around a mid-region or forward region thereof. Clamp 199 is comprised of a material strip 202 which has been, in effect, wrapped around the rod 197 and conformed therewith. The terminal end portion of this strip 202 is in adjacent, preferably spaced parallel relationship (when relaxed) to the adjacent strip 202 portions with the rod 197 body being nestled in the generally U-shaped bend region of clamp 199.

By extending one or two nut and bolt assemblies 201 through aligned apertures therebetween (with the assemblies 201 being preferably in spaced relationship to one another along the rod 197) and tightening the assemblies 201, a desired clamping effect is achieved between the enclosed portions of rod 197 and the material strip 202. The opposite terminal end portion of the material strip 202 is provided with a locking washer 203 which preferably (and as shown) is of the type having a plurality of circumferentially adjacent radially extending grooves defined in one face thereof. The locking washer 203, the material strip 202 and the clamp region 199 can, if desired, be unitarily formed and comprised of a molded plastic or like material.

An L-configured bracket 203 is also provided which has apertures formed in the foot portion thereof through which screws 204 or the like can be extended, thereby to mount bracket 203 to the under side of the top member 22" of desk 20" in a desired position between transparent plate 51" and the rear wall 28 (not shown in FIGS. 14 & 15) for holding the monitor 186. The leg of bracket 203 is terminally associated with a locking washer 206 which is matingly engagable with a locking washer 208 that is terminally associated with strip 202. The respective faces of these washers are brought together and clamped with a centrally extending screw 207 which threadably engages one washer 206 and slidably extends through the other washer 208 screw 207 preferably has an enlarged, manually rotatable head 209. The assembly of washer 206 and bracket 203 is preferably comprised of one-piece molded plastic or like material. Thus, the coaction between bracket 203, washers 206 and 208 clamp 199 and related components provide a tiltable suspending means for monitor 186.

A monitor suspending assembly of this invention thus incorporates suspending means for holding the forward upper region of a monitor in adjacent spaced relationship to the underside of the top surface member of a desk or work station structure and also suspending arm means for holding the rearward upper region of a monitor in spaced relatively remote relationship to this underside.

As can be appreciated from the above described embodiments, the monitor suspending assembly of this invention avoids the need for a shelf member or the like which supports bottom portions of a monitor assembly.

Also, the monitor suspending assembly of this invention is adapted for usage with monitors of various sizes and shapes and also for use with various desk-like structures or computer work stations that are equipped with a transparent portion in their working surfaces.

Various other and further embodiments, applications, structures, and the like will be apparent to those skilled in the art from the description provided herein and no undue limitations are to be implied or inferred therefrom.

What is claimed is:

1. A monitor suspending assembly for mounting within a desk-like structure that has a top surface member with a transparent portion through which the screen of a monitor that is suspended by said monitor suspending assembly is viewable, said monitor suspending assembly comprising:

(a) fastening means for independent association with each of the forward upper region of said monitor and the rearward upper region of said monitor; and (b) suspending means associated with said fastening means and including mounting means for connecting said suspending means with the underside of said top surface member, said suspending means including adjustment means for regulating the tilt angle of said monitor relative to said transparent portion about a laterally extending axis;

(c) said suspending means including:

a forward suspending portion held by a portion of said mounting means for connecting said forward suspending portion to said underside, and a rearward suspending portion held by a portion of said mounting means for connecting said rearward suspending portion to said underside, said rearward suspending portion including elongated arm means, and said arm means being associated with said adjustment means;

(d) said fastening means for said monitor forward upper region and said forward suspending portion being cooperative with each other to suspend said monitor forward upper region and also to define said laterally extending axis relative to which said monitor is tiltable so that said monitor tilt angle is adjustable relative to said transparent portion; and (e) said fastening means for said monitor rearward upper region and said rearward suspending portion being cooperative with each other to suspend said monitor rearward upper region with said monitor being positionable at a particular tilt angle by said elongated arm means and said adjustment means.

2. The monitor suspending assembly of claim 1 wherein said suspending means includes vertically changeable spacing means so that the vertical distance between the top of said monitor and said underside is adjustable.

3. The monitor suspending assembly of claim 1 wherein the effective length of said elongated arm means is variable and the angular relationship between said elongated arm means and each of said underside and said rearward upper region is variable.

4. The monitor suspending assembly of claim 3 wherein said elongated arm means and said adjustment means together comprise a turnbuckle assembly one of whose respective opposite ends is pivotably connected by said rearward mounting means to said underside and the other of whose respective opposite ends is pivotably connected to said fastening means for said monitor rearward upper region.

5. The monitor suspending assembly of claim 3 wherein said elongated arm means comprises strap means and said rearward mounting means comprises hook means at each end of said strap means that are associated with eyelet means fixed to said underside and to said fastening means for said monitor rearward upper region.

6. The monitor suspending assembly of claim 5 wherein said strap means includes a plurality of longitudinally spaced locations adjacent one end thereof, any one of which locations is individually associatable with said hook means at said one end so that the effective length of said strap means is variable, thereby to provide said adjustment means.

7. The adjustable monitor support assembly of claim 1 which is mounted within, and is thus in combination with, a desk-like structure.

* * * * *